US007272997B1

(12) United States Patent
Lee et al.

(10) Patent No.: US 7,272,997 B1
(45) Date of Patent: Sep. 25, 2007

(54) FLOATABLE HAND TOOL

(76) Inventors: Yu-Jyun Lee, No. 148, Chaofu Rd., Situn District, Taichung City (TW) 40757; Yu-Hao Lee, No. 148, Chaofu Rd., Situn District, Taichung City (TW) 40757

( * ) Notice: Subject to any disclaimer, the term of this patent is extended or adjusted under 35 U.S.C. 154(b) by 0 days.

(21) Appl. No.: 11/409,654

(22) Filed: Apr. 24, 2006

(51) Int. Cl.
*B25B 15/00* (2006.01)
*B25B 23/16* (2006.01)
*B25G 1/00* (2006.01)

(52) U.S. Cl. ..... 81/177.1; 81/436

(58) Field of Classification Search ..... 81/177.1, 81/436, 438
See application file for complete search history.

(56) References Cited

U.S. PATENT DOCUMENTS 3,935,762 A * 2/1976 Tudisco ..... 81/177.85
4,056,020 A * 11/1977 Coviello ..... 81/177.2
4,096,896 A * 6/1978 Engel ..... 81/121.1
4,336,729 A * 6/1982 Eppenbach ..... 81/439
4,672,745 A * 6/1987 Wilkens ..... 30/340
5,359,911 A * 11/1994 Kruesi ..... 81/436
5,601,003 A * 2/1997 Amtenbrink et al. ..... 81/489
5,638,727 A * 6/1997 Gringer ..... 81/438
5,865,077 A * 2/1999 Moffitt et al. ..... 81/427.5
6,202,518 B1 * 3/2001 Moffitt et al. ..... 81/427.5
6,655,240 B1 * 12/2003 DeVecchis et al. ..... 81/438
6,726,516 B2 * 4/2004 Sowry et al. ..... 441/1
6,776,073 B1 * 8/2004 Brady et al. ..... 81/427.5
6,877,405 B2 * 4/2005 Brady et al. ..... 81/427.5
6,966,244 B2 * 11/2005 Herbst et al. ..... 81/418
2002/0139225 A1 * 10/2002 Carter ..... 81/176.3
2003/0131694 A1 * 7/2003 Lin ..... 81/438
2003/0140744 A1 * 7/2003 Chen ..... 81/438
2004/0020330 A1 * 2/2004 Hu ..... 81/177.1
2004/0261585 A1 * 12/2004 Birns ..... 81/125.1
2006/0053985 A1 * 3/2006 Chen ..... 81/489
2006/0254392 A1 * 11/2006 Frank ..... 81/52

* cited by examiner

*Primary Examiner*—David B Thomas
(74) *Attorney, Agent, or Firm*—Shia Banger

(57) ABSTRACT

A floatable hand tool includes a shank having an inner wall formed with an axially extending through hole, and a tool tip mounted on an end of the shank and having an end portion provided with a protruding connecting rod inserted into the through hole of the shank so that the through hole of the shank forms a closed chamber. Thus, the floatable hand tool floats on the water level by the floating force produced by the closed chamber the through hole of the shank. In addition, the floatable hand tool floats on the water level, thereby preventing the floatable hand tool from being missed when falling into the water, and thereby facilitating a user operating the floatable hand tool in the water.

10 Claims, 10 Drawing Sheets

FLOATABLE HAND TOOL

BACKGROUND OF THE INVENTION

1. Field of the Invention

The present invention relates to a hand tool, and more particularly to a floatable hand tool.

2. Description of the Related Art

A conventional hand tool, such as a screwdriver or the like, comprises a shank, a tool tip mounted on a first end of the shank, and a handle mounted on a second end of the shank. The shank and the tool tip are made of metallic material so that the hand tool has a heavier weight. However, the hand tool is directly immersed in the water due to its heavier weight, so that the hand tool is easily lost when falling into the water, thereby causing inconvenience to a user when operating the hand tool in the water.

SUMMARY OF THE INVENTION

The present invention is to mitigate and/or obviate the disadvantage of the conventional hand tool.

The primary objective of the present invention is to provide a hand tool that is floatable on the water level.

Another objective of the present invention is to provide a floatable hand tool that floats on the water level by the floating force produced by the closed chamber the through hole of the shank and by the light weight of the handle and the shank.

A further objective of the present invention is to provide a floatable hand tool that floats on the water level automatically, thereby preventing the floatable hand tool from being missed when falling into the water, and thereby facilitating a user operating the floatable hand tool in the water.

A further objective of the present invention is to provide a floatable hand tool that has a light weight so as to reduce the burden applied on the user, thereby facilitating the user carrying the floatable hand tool.

In accordance with the present invention, there is provided a floatable hand tool, comprising:

a shank having an inner wall formed with an axially extending through hole;

a tool tip mounted on a first end of the shank and having an end portion provided with a protruding connecting rod inserted into the through hole of the shank so that the through hole of the shank forms a closed chamber.

Further benefits and advantages of the present invention will become apparent after a careful reading of the detailed description with appropriate reference to the accompanying drawings.

DETAILED DESCRIPTION OF THE INVENTION

Figure 1:
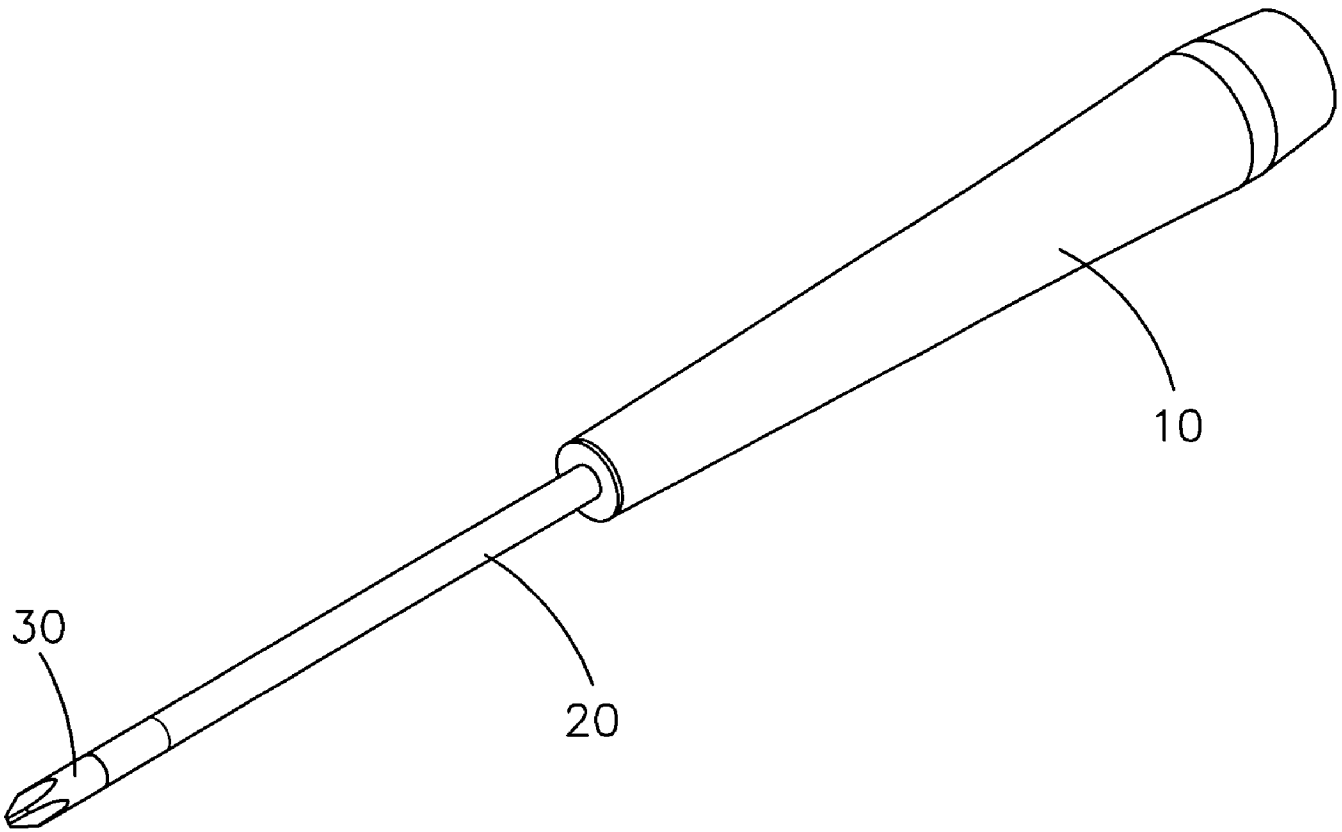
FIG. 1 is a perspective view of a floatable hand tool in accordance with the preferred embodiment of the present invention.
Figure 2:
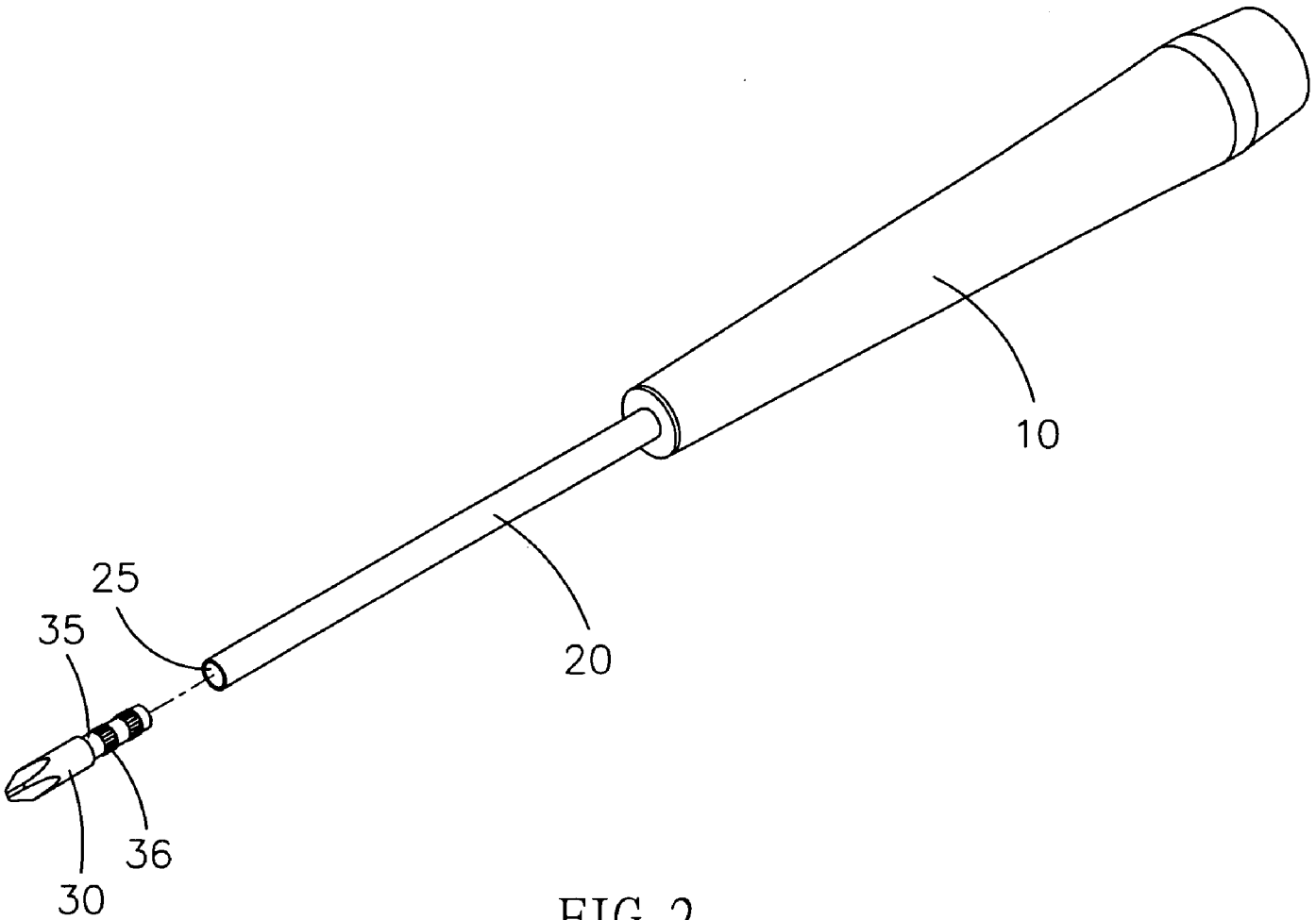
FIG. 2 is a partially exploded perspective view of the floatable hand tool as shown in FIG. 1.
Figure 3:
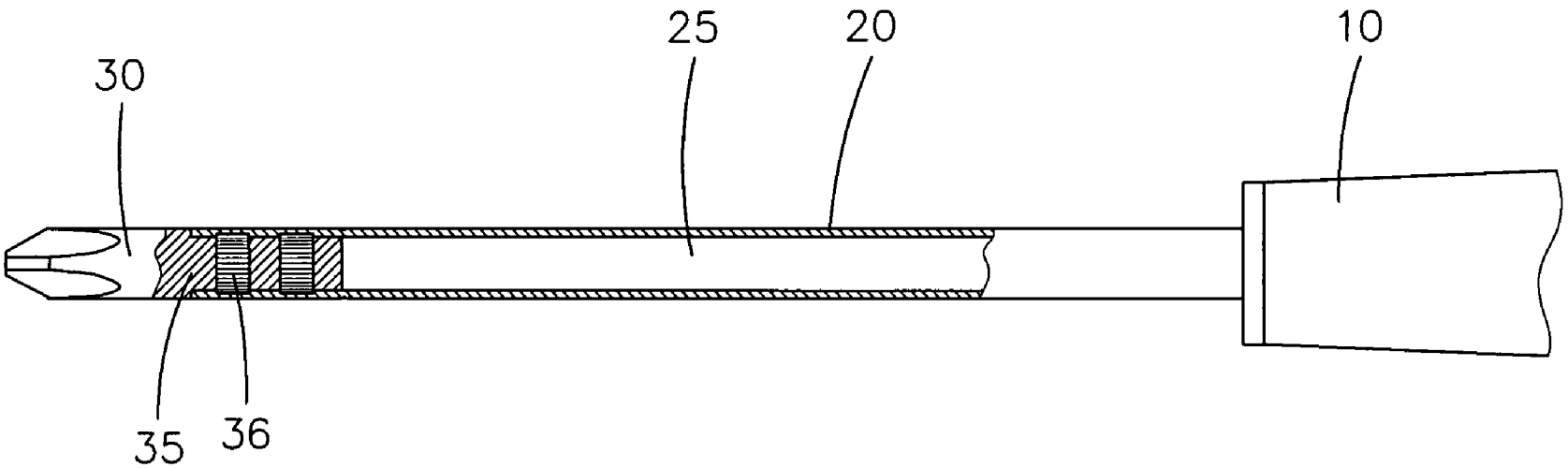
FIG. 3 is a partially plan cross-sectional view of the floatable hand tool as shown in FIG. 1.
Figure 4:
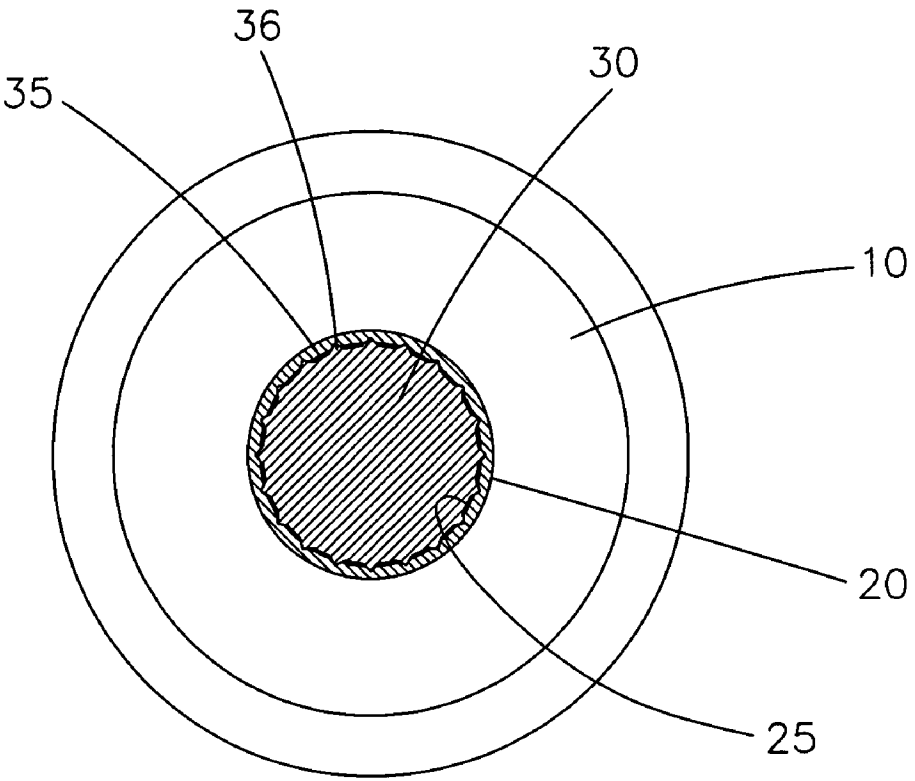
FIG. 4 is a side plan cross-sectional view of the floatable hand tool as shown in FIG. 1.

Referring to the drawings and initially to FIGS. 1-4, a floatable hand tool in accordance with the preferred embodiment of the present invention comprises a shank 20 having an inner wall formed with an axially extending through hole 25, a tool tip 30 mounted on a first end of the shank 20 and having an end portion provided with a protruding connecting rod 35 inserted into the through hole 25 of the shank 20 so that the through hole 25 of the shank 20 forms a closed chamber, and a handle 10 mounted on a second end of the shank 20.

In the preferred embodiment of the present invention, the floatable hand tool is a screwdriver.

The connecting rod 35 of the tool tip 30 has a periphery provided with at least one engaging tooth section 36 which engages the inner wall of the shank 20. Preferably, the shank 20 has an outer wall that is compressed inwardly by a roll press process so that the inner wall of the shank 20 closely presses the engaging tooth section 36 of the connecting rod 35. Thus, the connecting rod 35 of the tool tip 30 is closely locked in the through hole 25 of the shank 20, so that the tool tip 30 is connected the shank 20 closely without incurring slip between the tool tip 30 and the shank 20.

The handle 10 is made of a plastic material that has a light weight and is waterproof.

Figure 5:
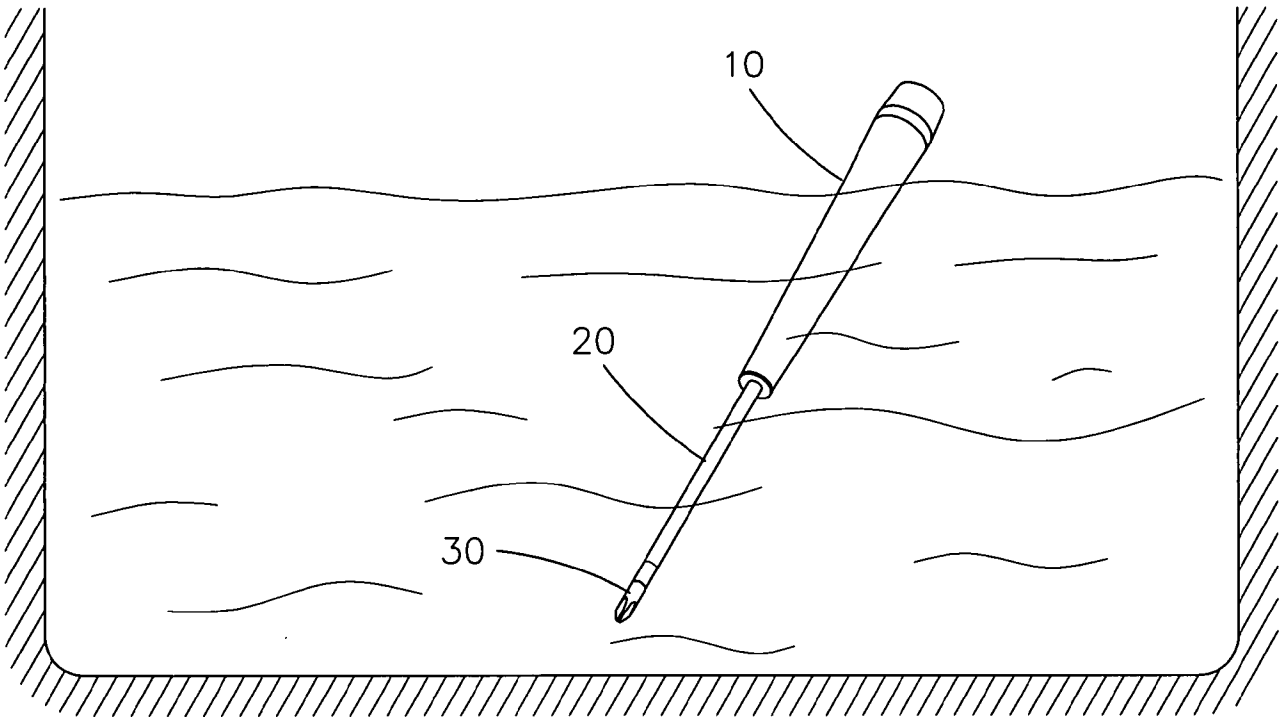
FIG. 5 is a schematic plan view showing the floatable hand tool floating in the water.

Referring to FIGS. 1-5, the through hole 25 of the shank 20 forms a closed chamber to produce a floating force and to reduce the weight of the shank 20, and the handle 10 is made of a waterproof plastic material having a light weight, so that when the floatable hand tool falls into the water as shown in FIG. 5, the floatable hand tool floats on the water level by the floating force produced by the closed chamber the through hole 25 of the shank 20 and by the light weight of the handle 10 and the shank 20.

Accordingly, the floatable hand tool floats on the water level by the floating force produced by the closed chamber the through hole 25 of the shank 20 and by the light weight of the handle 10 and the shank 20. In addition, the floatable hand tool floats on the water level automatically, thereby preventing the floatable hand tool from being missed when falling into the water, and thereby facilitating a user operating the floatable hand tool in the water. Further, the floatable hand tool has a light weight so as to reduce the burden applied on the user, thereby facilitating the user carrying the floatable hand tool.

Figure 6:
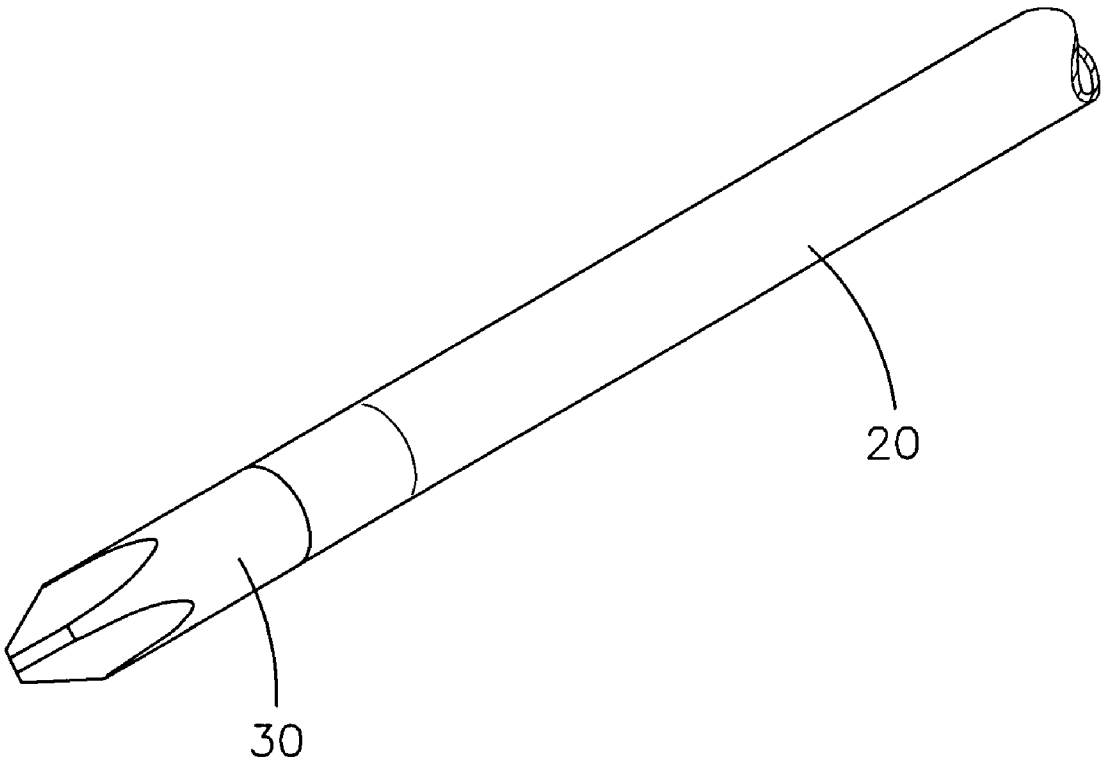
FIG. 6 is a partially cut-away perspective view of a floatable hand tool in accordance with another preferred embodiment of the present invention.
Figure 7:
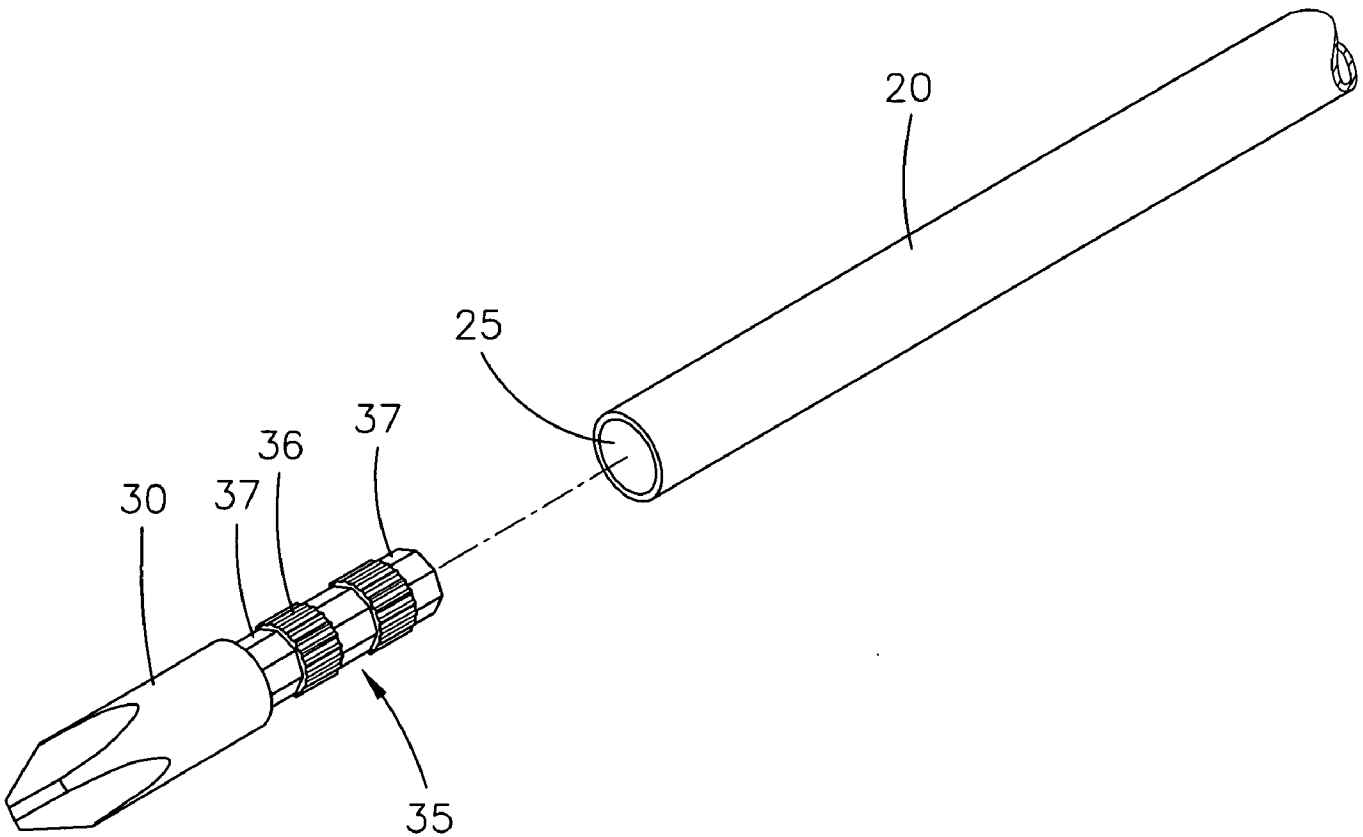
FIG. 7 is an exploded perspective view of the floatable hand tool as shown in FIG. 6.

Referring to FIGS. 6 and 7, the periphery of the connecting rod 35 of the tool tip 30 is further provided with at least one polygonal section 37 which presses the inner wall of the shank 20. Preferably, the shank 20 has an outer wall that is compressed inwardly by a roll press process so that the inner wall of the shank 20 closely presses the engaging tooth section 36 and the polygonal section 37 of the connecting rod 35. Thus, the connecting rod 35 of the tool tip 30 is closely locked in the through hole 25 of the shank 20, so that the tool tip 30 is connected the shank 20 closely without incurring slip between the tool tip 30 and the shank 20.

Figure 8:
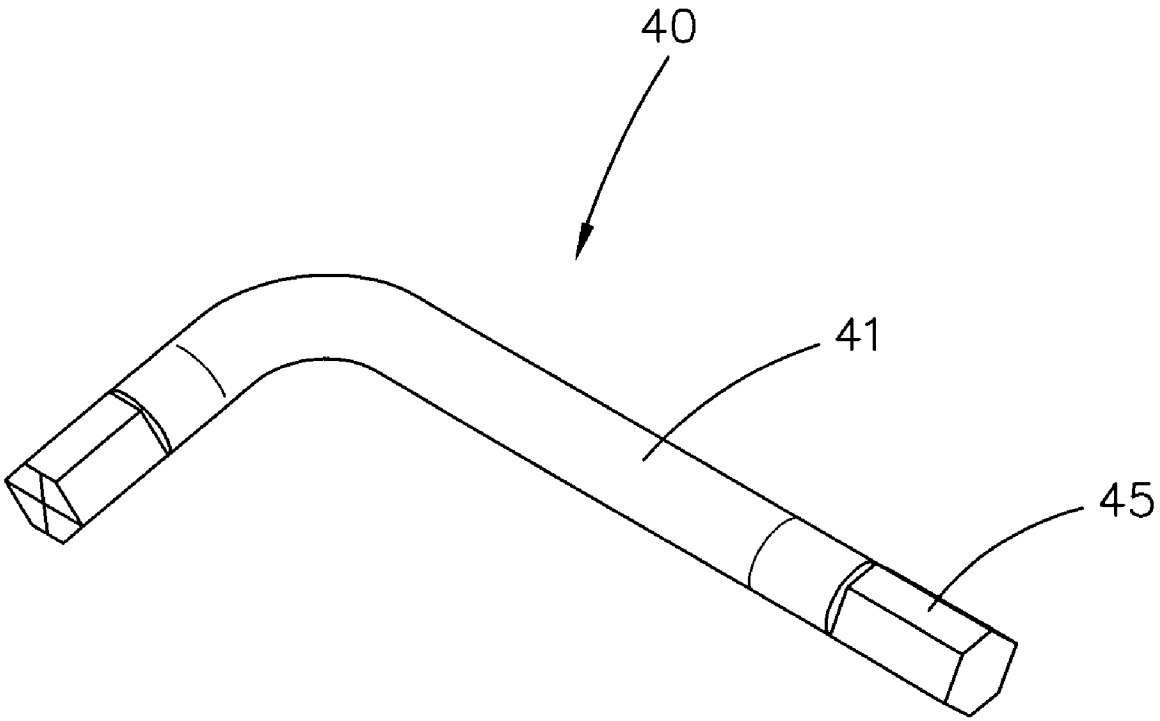
FIG. 8 is a perspective view of a floatable hand tool in accordance with another preferred embodiment of the present invention.

Referring to FIG. 8, the floatable hand tool is a hex wrench 40 comprising a substantially L-shaped shank 41, and at least one tool tip 45 mounted on one end of the shank 41.

Figure 9:
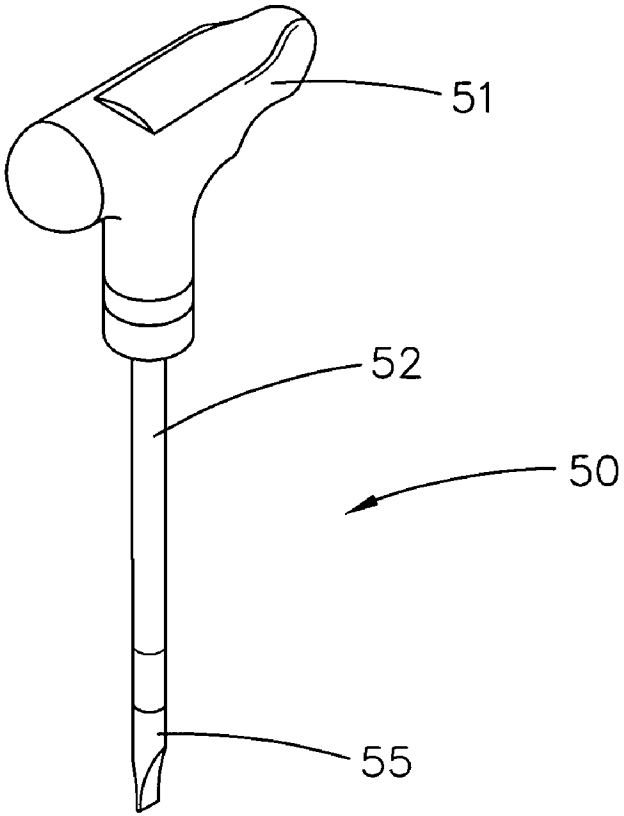
FIG. 9 is a perspective view of a floatable hand tool in accordance with another preferred embodiment of the present invention.

Referring to FIG. 9, the floatable hand tool is a T-shaped wrench 50 comprising a shank 52, a tool tip 55 mounted on a first end of the shank 52, and a substantially T-shaped handle 51 mounted on a second end of the shank 52.

Figure 10:
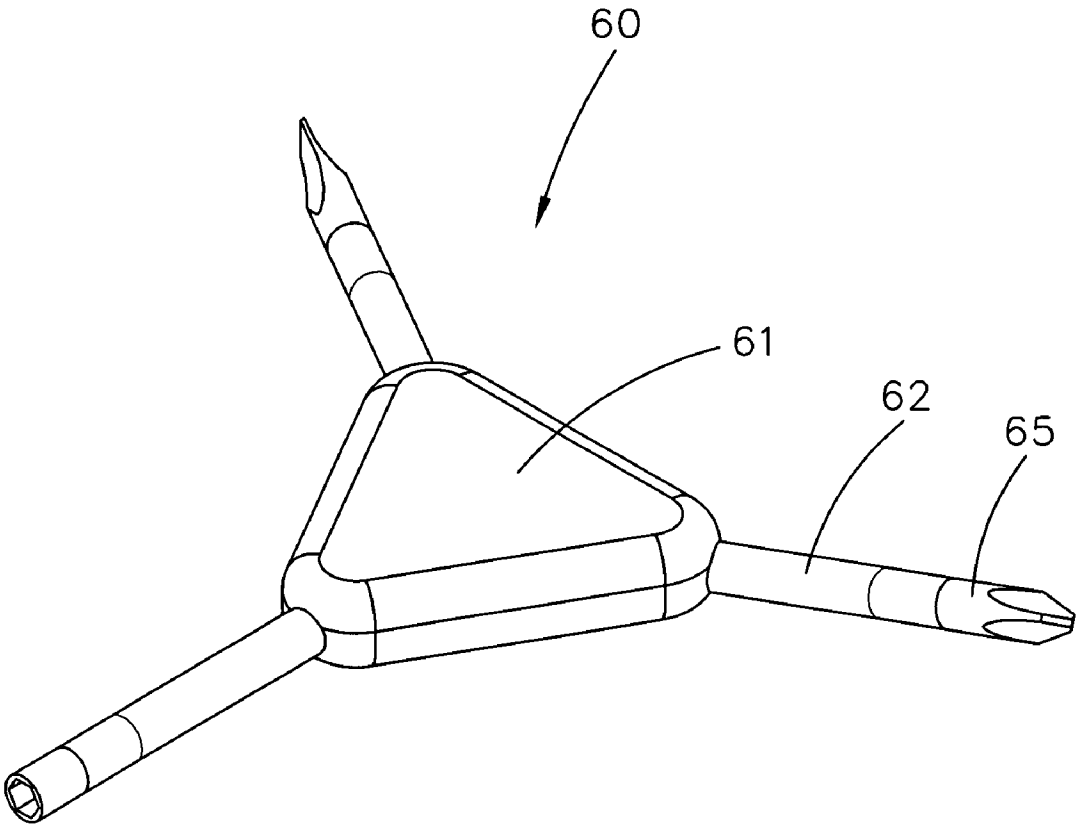
FIG. 10 is a perspective view of a floatable hand tool in accordance with another preferred embodiment of the present invention.

Referring to FIG. 10, the floatable hand tool is a Y-shaped wrench 60 comprising a handle 61, three shanks 62 each having a first end mounted on the handle 61, and three tool tips 65 each mounted on a second end of the respective shank 62.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A floatable hand tool, comprising:

a shank having an inner wall formed with an axially extending through hole;

a tool tip mounted on a first end of the shank and having an end portion provided with a protruding connecting rod inserted into the through hole of the shank;

a handle mounted on a second end of the shank so that the through hole of the shank forms a closed chamber which is defined by the tool tip and the handle and extends from the first end to the second end of the shank;

wherein the handle is made of a plastic material that has a light weight;

the floatable hand tool is floatable on a water level by a floating force which is produced by the closed chamber of the through hole of the shank and by the light weight of the handle made of a plastic material.

2. The floatable hand tool in accordance with claim 1, wherein the connecting rod of the tool tip has a periphery provided with at least one engaging tooth section which engages the inner wall of the shank;

the shank has an outer wall that is compressed inwardly so that the inner wall of the shank closely presses the engaging tooth section of the connecting rod, and the engaging tooth section of the connecting rod is extended into and locked in the inner wall of the shank;

the connecting rod of the tool tip is closely locked in the through hole of the shank, so that the connecting rod of the tool tip is combined with the shank closely without incurring slip between the tool tip and the shank to prevent the tool tip from being detached from the shank.

3. The floatable hand tool in accordance with claim 2, wherein the periphery of the connecting rod of the tool tip is further provided with at least one polygonal section which is located beside the engaging tooth section and presses the inner wall of the shank.

4. The floatable hand tool in accordance with claim 3, wherein the inner wall of the shank closely presses the engaging tooth section and the polygonal section of the connecting rod so that the connecting rod of the tool tip is combined with the shank integrally.

5. The floatable hand tool in accordance with claim 1, wherein the handle is waterproof.

6. The floatable hand tool in accordance with claim 1, wherein the floatable hand tool is a screwdriver.

7. The floatable hand tool in accordance with claim 1, wherein the floatable hand tool is a hex wrench.

8. The floatable hand tool in accordance with claim 1, wherein the floatable hand tool is a T-shaped wrench.

9. The floatable hand tool in accordance with claim 1, wherein the floatable hand tool is a Y-shaped wrench.

10. The floatable hand tool in accordance with claim 1, wherein the through hole of the shank has a cylindrical wall which has a constant diameter extending from the first end to the second end of the shank.

* * * * *